US009447512B2

(12) United States Patent
Yadav et al.

(10) Patent No.: US 9,447,512 B2
(45) Date of Patent: Sep. 20, 2016

(54) ELECTROCHEMICAL CELL USED IN PRODUCTION OF HYDROGEN USING CU—CL THERMOCHEMICAL CYCLE

(75) Inventors: Ganapati Dadasaheb Yadav, Mumbai (IN); Prakash Santoshrao Parhad, Mumbai (IN); Ashwini Bhagavan Nirukhe, Mumbai (IN); Parvatalu Damaraju, New Delhi (IN); Anil Bhardwaj, New Delhi (IN); Bantwal Narayana Prabhu, New Delhi (IN); Nuzhath Joeman Thomas, New Delhi (IN); Dilip Madhusudan Kale, New Delhi (IN)

(73) Assignees: INSTITUTE OF CHEMICAL TECHNOLOGY, East Mumbai (IN); ONGC ENERGY CENTRE TRUST, New Delhi (IN)

( * ) Notice: Subject to any disclaimer, the term of this patent is extended or adjusted under 35 U.S.C. 154(b) by 258 days.

(21) Appl. No.: 14/131,395

(22) PCT Filed: Jul. 9, 2012

(86) PCT No.: PCT/IN2012/000486

§ 371 (c)(1),
(2), (4) Date: Apr. 28, 2014

(87) PCT Pub. No.: WO2013/054342

PCT Pub. Date: Apr. 18, 2013

(65) Prior Publication Data

US 2014/0246307 A1 Sep. 4, 2014

(30) Foreign Application Priority Data

Jul. 8, 2011 (IN) ..... 1975/MUM/2011

(51) Int. Cl.
*C25C 5/02* (2006.01)
*C25C 7/02* (2006.01)
(Continued)

(52) U.S. Cl.
CPC . *C25C 7/02* (2013.01); *C25C 1/12* (2013.01); *C25C 5/02* (2013.01); *C25C 7/00* (2013.01); *C25C 7/04* (2013.01); *C25C 7/08* (2013.01)

(58) Field of Classification Search
None
See application file for complete search history.

(56) References Cited

U.S. PATENT DOCUMENTS 2,964,453 A * 12/1960 Garn ..... C23F 1/46 204/208
4,028,199 A 6/1977 Holland
(Continued)

FOREIGN PATENT DOCUMENTS

WO 99/40240 8/1999

OTHER PUBLICATIONS

International Search Report issued in PCT/IN2012/000486, mailed Jun. 26, 2013, 4 pages.

*Primary Examiner* — Harry D Wilkins, III
(74) *Attorney, Agent, or Firm* — Fish & Richardson P.C.; Vasily A. Ignatenko

(57) ABSTRACT

The electrochemical cell consists of hollow tube and centralized copper rod. The tubes have first and second ends. The first end cap is used to close the first open end. The anolyte inlet is extended through the first end cap in anolyte compartment and catholyte inlet is extended through the first end cap in catholyte compartment. The anolyte and catholyte compartments are separated by ion exchange membrane fixed over inner hollow tube having holes on the surface. A first Teflon gasket has provision for inlet of anolyte and catholyte tube is secured between first tubes end and first end cap. The copper rod is placed at the center of the tubes acts as cathode. The circular ring works as scrapper to take out deposited copper is provided. A second end cap is used to close the second open. A second Teflon gasket is secured between second tubes end and second end cap. The second end cap has provision for anolyte outlet and comprises a conical dome to collect the deposited copper and transport it along with catholyte. The anolyte trappers and catholyte trappers are connected through the tubes to anolyte and catholyte half cells. The anolyte and catholyte are recirculated through peristaltic pumps, one on each side.

21 Claims, 12 Drawing Sheets

Electrochemical cell for recovery of metals

(51) Int. Cl.

| | |
|---|---|
| ***C25C 7/08*** | (2006.01) |
| ***C25C 1/12*** | (2006.01) |
| ***C25C 7/00*** | (2006.01) |
| ***C25C 7/04*** | (2006.01) |

(56) References Cited

U.S. PATENT DOCUMENTS 4,242,193 A * 12/1980 Moeglich ..... B01D 61/50 204/252
6,086,733 A * 7/2000 Carey ..... C02F 1/46109 204/242
2003/0183535 A1 10/2003 Bandlish et al.
2004/0140222 A1* 7/2004 Smedley ..... C25C 1/00 205/337
2005/0067291 A1 3/2005 Haiki et al.
2005/0183947 A1* 8/2005 Henuset ..... C25C 7/08 204/216
2006/0016696 A1 1/2006 Stevens et al.
2008/0283390 A1* 11/2008 Fan ..... C25C 1/12 204/242

* cited by examiner

Electrochemical cell for recovery of metals

Component used in the electrochemical cell: Graphite Anode 2, Copper cathode 3, an ion exchange membrane supported by corrosion resistant material Side view of first end and second end used in electrochemical cell Top view of first end and second end Teflon gasket and mechanical scrapper SEM image of deposited copper powder XRD pattern of deposited copper powder SEM image of deposited silver powder XRD pattern of deposited silver powder SEM image of deposited zinc powder XRD pattern of deposited zinc powder SEM image of deposited cobalt powder XRD pattern of deposited lead powder

ELECTROCHEMICAL CELL USED IN PRODUCTION OF HYDROGEN USING CU—CL THERMOCHEMICAL CYCLE

CROSS REFERENCE TO RELATED APPLICATIONS

This application is a U.S. National Phase Application under 35 U.S.C. §371 of International Patent Application No. PCT/IN2012/000486 filed Jul. 9, 2012, which claims the benefit of Indian Patent Application Serial No. 1975/MUM/2011 filed Jul. 8, 2011, both of which are incorporated herein by reference in their entirety.

FIELD OF INVENTION

The present invention related to tubular electrochemical cell for electrolysis of cuprous chloride to copper powder and cupric chloride. The material used for fabrication of cell is dense graphite tube as anode and dense copper rod as cathode, separated by ion exchange membrane supported by acrylic tube. Electrochemical cell of invention can be used for recovery of metals such as silver, zinc and lead from their salt solutions.

BACKGROUND OF THE INVENTION

Many industries like plating, mining and metal finishing were also using electrolysis to recover metal from the electrolyte. Recovery of copper from the solutions containing copper metal in the form of ions is well known process. In CuCl cycle the copper consume in hydrogen production step is reproduced in the cathode side of electrolysis. The cupric chloride formed in the anode side was used as starting material for hydrolysis of cupric chloride and decomposition of cupric chloride.

U.S. Ser. No. 00/542,1966A used the electrolysis process for regeneration of acid cupric chloride etching bath to recover copper metal. The applicant used graphite rod as anode and cathode electrodes. Micro porous separator was used for separation of anolyte and catholyte solution.

US20080283390A1 describer a method for electrolysis of cuprous chloride to produce copper powder and cupric chloride. Dense graphite was used as working electrodes as anode and cathode. Anion exchange membrane made up from poly and polyethylenimine cross-linked is used as a separating medium. The electrodes are designed in the form of channels rib manner. The electrolyte flows through the respective channels. The main problem faced is the removal of copper powder formed during the electrolysis. The applicants have used different additives to enhance the solubility of CuCl. To increase the conductivity of solution was seeded with carbon black material.

US2010051469A1 used electrochemical cell for production of hydrogen gas and cupric chloride from the electrolysis of cuprous chloride. The anolyte and catholyte used were cuprous chloride in hydrochloric acid and water respectively. Cation exchange membrane was used as separating medium between the anode and cathode compartment.

OBJECTIVE OF THE INVENTION

One of the objectives of the present invention is to design the electrochemical cell for electrolysis of cuprous chloride using acid resistant material to get required size of copper powder.

Another objective of the present invention is recovery of metals such as silver, zinc and lead from their salt solutions.

Another objective of the present invention is to achieve desired particle of metal which is to be recovered.

Another objective of the present invention is to design an electrochemical cell with anode and cathode with effective surface area for desired metal particle.

SUMMARY OF INVENTION

A thermochemical Cu—Cl thermochemical cycle consists of six steps: (1) hydrogen production; (2) electrolysis of cuprous chloride; (3) drying of cupric chloride; (4) hydrolysis of cupric chloride; (5) decomposition of cupric chloride and (6) oxygen production step. Using tubular/cylindrical electrochemical cell of invention copper is produced.

The present electrochemical cell for recovery of metals comprises of

- a dense graphite as anode,
- a dense copper as cathode,
- and an ion exchange membrane supported by corrosion resistant material.

The electrochemical cell of this invention is capable of recovering metals such as copper, silver, zinc, and lead from their salt solutions at either high or very low concentrations.

In accordance with one aspect of present invention, there is provided an electrochemical cell for production of copper from cuprous chloride generated in Copper-Chlorine (Cu—Cl) thermochemical cycle.

The high surface area ratio of anode to cathode gives maximum cathodic current density providing fine and uniform particle size.

BRIEF DESCRIPTION OF THE DRAWING

Embodiments of the inventions will be described in conjunction with the accompanying drawing, wherein.

DETAIL DESCRIPTION OF THE INVENTION

The invention relates about electrolysis of cuprous chloride to copper powder on cathodic side and formation of cupric chloride on anodic side of the cell. By implementing the invention it is possible to electrolyze cuprous chloride and effectively removes and recovers the copper powder formed during the electrolysis. The electrolysis cell is made using tubular graphite anode and copper rod separated by ion exchange membrane supported by acrylic cylinders.

Using tubular electrochemical cell of invention copper is produced. Similarly same tubular/cylindrical electrochemical cell can be used for other metals like silver, zinc and lead.

By implementing the invention it is possible to recover metal effectively by electrochemical cell of present invention wherein electrolysis of electrolyte to recover metal is carried out. The electrolysis cell is made up of using graphite cylinder and copper rod separated by an ion exchange membrane supported by acid resistant material.

As elaborated in detail below, the main problems in the electrolysis of cuprous chloride like removal of copper powder deposited on cathode, obtaining the desired size of the copper powder in continuous operation, removal of copper powder from the closed loop and scale up of the electrolyte cell are solved by implementing the present invention.

An electrochemical cell of invention for recovery of metals comprising of at least one anode disposed in electrolyte; at least one cathode disposed in electrolyte; at least one ion exchange membrane disposed between the anode compartment and the cathode compartment a corrosion resistant material support to ion exchange membrane; at least one scraper to remove deposited metal from the cathode and at least one catholyte trapper collects scraped metal powder.

Figure 1:
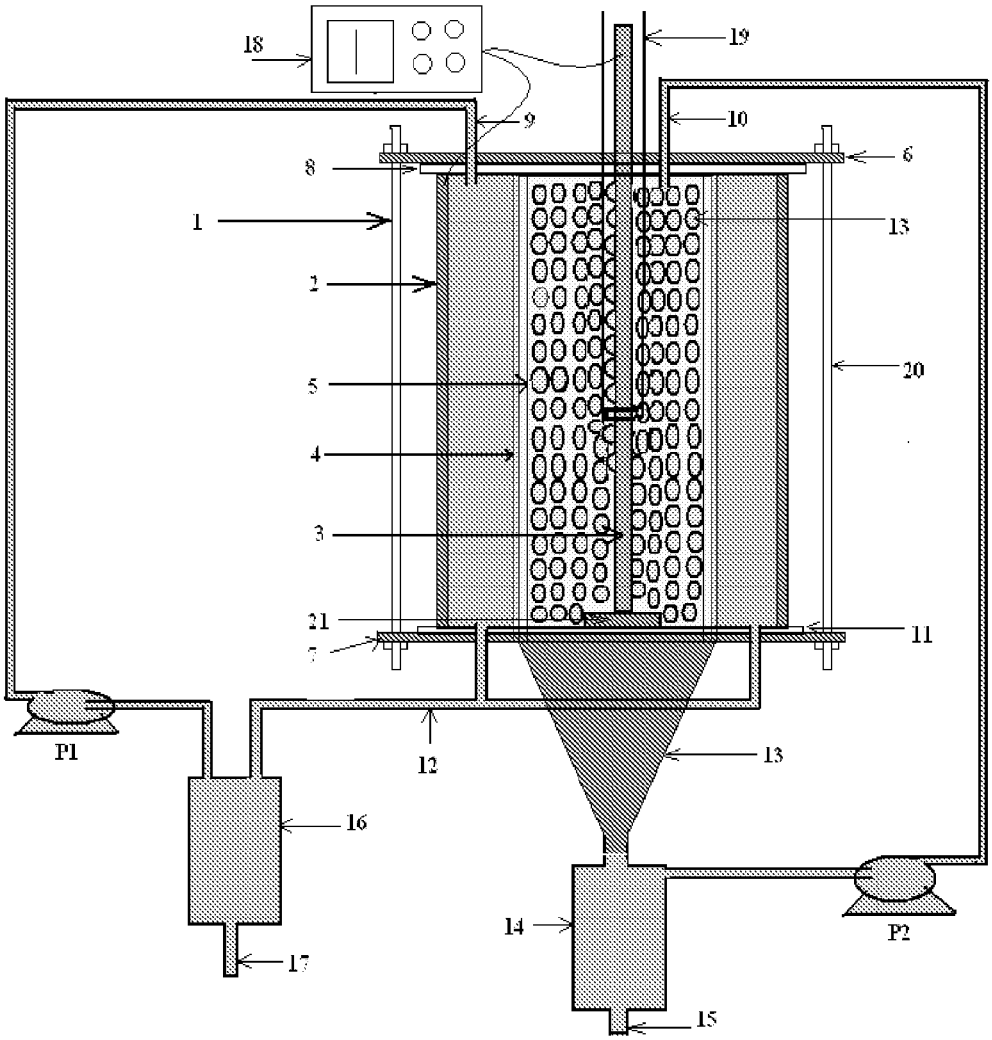
FIG. 1 is an illustration of an electrochemical cell configuration, according to an embodiment of the present invention

The invention deals with closed loop electrochemical cell 1 used for the electrolysis of cuprous chloride is shown in FIG. 1.

Figure 2:
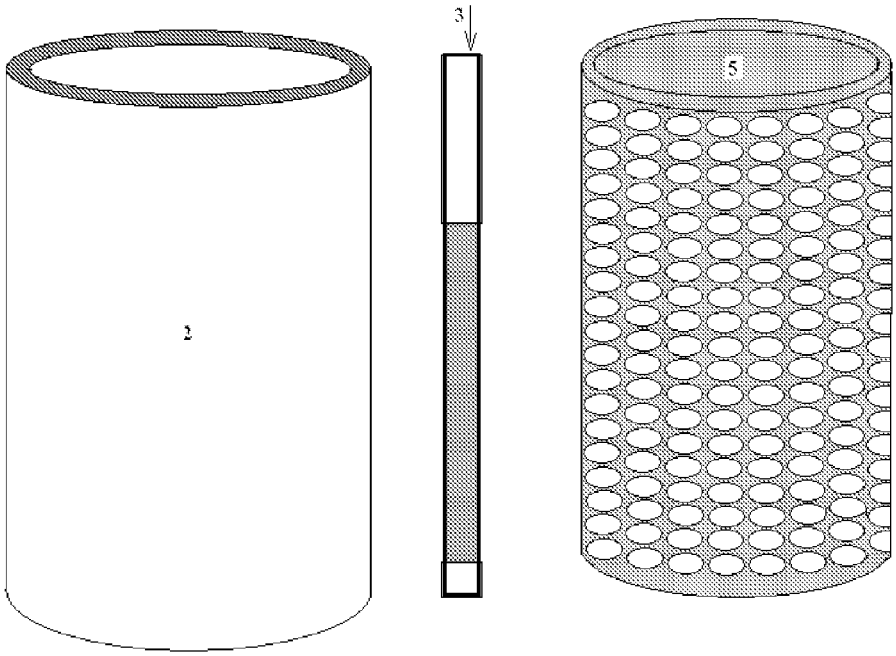
FIG. 2 is a schematic of graphite anode, copper cathode and corrosion resistant material such as acrylic as a support to membrane used in the present invention.

In accordance with present invention anode 2 is constructed of dense open ended graphite cylinder as shown in FIG. 2. The electrode is impervious to gas and liquid. Dense copper rod is used as a cathode. Copper rod 3 (shown in FIG. 2) having the smooth working surface placed at the centre and axially parallel to the length of the graphite cylinder. Only the required surface is exposed to the catholyte and remaining surface is coated with electrical resistance material. To provide mechanical support grove of acrylic 21 is provided at the bottom of copper rod.

In accordance to the invention, the distance between anode and cathode may be varied by changing the inner diameter of the graphite tube/cylinder and outer diameter of copper rod. The separation of anolyte and catholyte is done using an anion exchange membrane 4 having support of acrylic cylinder 5 (shown in FIG. 2) placed in between anode and cathode.

In this invention for the passage of ions between anolyte and catholyte, the holes are made on the surface of the acrylic cylinder which acts as a support to the anion exchange membrane. The diameter of acrylic cylinder used in electrolysis is slightly small than the half the inner diameter of graphite tube/cylinder used as anode. Thus a cathode is placed coaxial and at the center of an anode.

Figure 3:
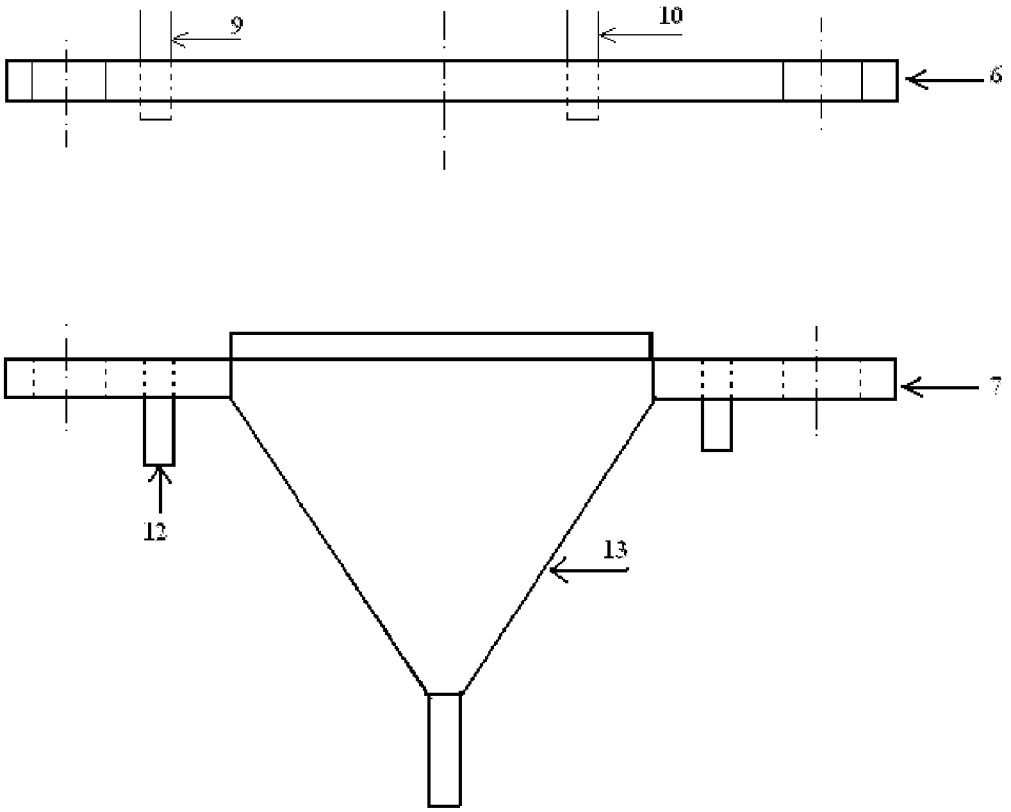
FIG. 3 is a schematic of first end and second end used in electrochemical cell.

In this invention, graphite cylinder and acrylic cylinders are of similar length. The first open ends of the graphite cylinder and acrylic cylinders are packed with the help of first end caps 6 and second open ends of the graphite cylinder and acrylic cylinders are packed with second end cap 7. The second end cap shown in FIG. 3 has a cone shape dome 13 at the centre. Both the end caps are made up of acrylic material. First teflon gasket 8 is secured in between the first open ends and first end caps. It has provision for inlets of anolyte tube 9, a catholyte tube 10, copper rod 3, and mechanical scraper 19. The second teflon gasket 11 is placed in between second end and second end cap which provides provision for anolyte outlet 12 and catholyte passage 13. The cone have top diameter equal to inner diameter of acrylic tube and solid angle 40°. It collects copper particles separated from cathode surface and transfers it to catholyte trapper 14 where collected copper is taken out through the stopper (not shown) connected at the end of outlet 15 to catholyte trapper.

Figure 4:
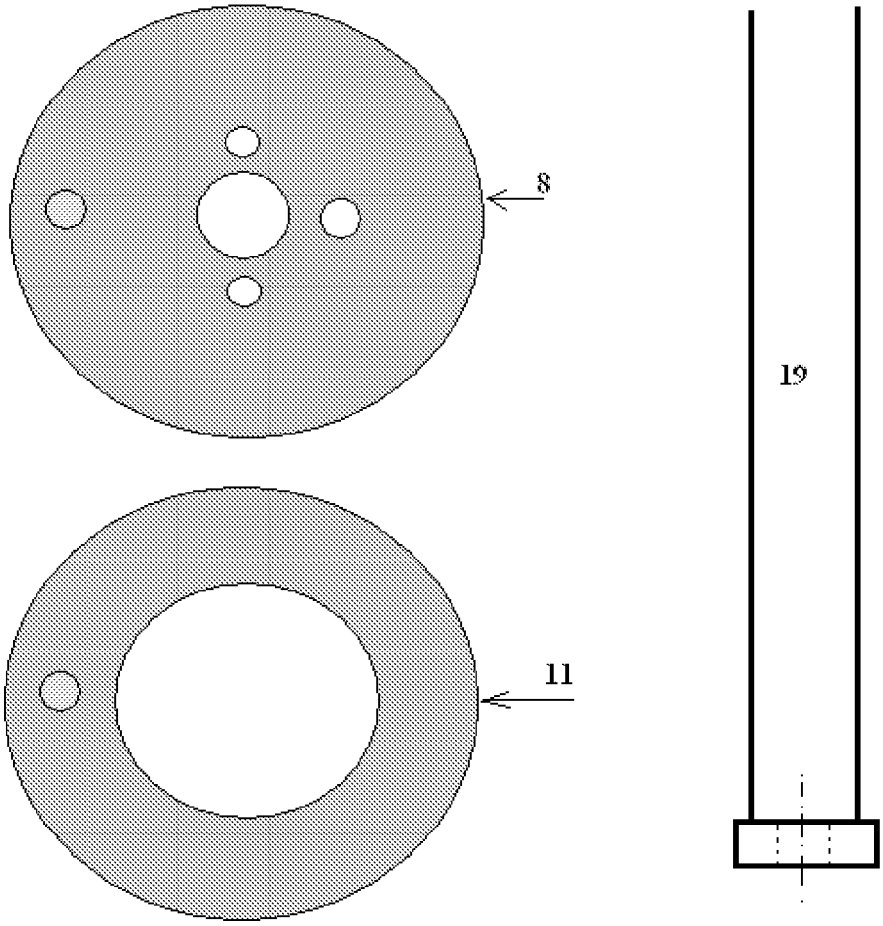
FIG. 4 is a schematic of first end and second end teflon gasket and mechanical scraper used in electrochemical cell.

The top view of first teflon gasket and second teflon gasket is shown in FIG. 4. First teflon gasket has provision for inlet of anolyte. Catholyte tube is placed in between first tubes end and first end cap. The outlet of anode compartment 12 and outlet of cathode compartment 7 are connected to inlet of anolyte trapper 16 and catholyte trapper 14 respectively. The copper get settled by gravity at the bottom of catholyte trapper and are removed. The outlet 17 of anolyte trapper is used to take out the formed cupric chloride from copper recovery and respective salt solutions for other metals. The anolyte closed loop is completed by circulating the anolyte using peristaltic pump P1 from anolyte trapper to the inlet provided on anolyte side of electrochemical cell. Similarly catholyte closed loop is completed by circulating the catholyte using peristaltic pump P2 from catholyte trapper to the inlet provided on catholyte side of electrochemical cell.

The power supply is provided by means of rectifier 18. The required quantity of current is passed through the electrolyte. The positive end of rectifier connected to the graphite tube/cylinder which acts as anode and negative end connected to copper rod which acts as cathode.

The first end and second end of the cell are kept intact using nut bolt 20 as shown in FIG. 1.

Thus one of the embodiment of the invention is that anode can be composed of corrosion resistant conductive metals, conductive carbon material and any non-conductive material coated by conductive materials. Further an anode can be graphite but an anode is hollow.

One of the embodiment of the present invention is that a cathode can be composed of corrosion resistant conductive metals, conductive carbon material and any non conductive material coated by conductive materials. Thus cathode can be copper and of any geometry by keeping both ends of an anode open.

Anode and cathode have surface area in the ratio of range of 1:1 to 1:50; most preferably in the range of 1:6 to 1:15.

It is found that support is made of corrosion resistant and non conductive material and can be selected from a ceramic, thermoplastic or thermoset polymeric material.

Another embodiment of the invention is that support in electrochemical cell is provided with openings for ion transport from anolyte to catholyte wherein these openings on the support can be of any geometry. But for present invention these openings on the support are of any size and uniformly distributed area having area covered in the range of 10% to 95% of total area of support.

One of the embodiment of the invention id that scraper provided to cathode and composed of corrosion resistant and non conductive material. Scraper can be composed of a ceramic, thermoplastic or thermoset polymeric material.

An electrochemical cell according to present invention wherein anode and cathode are partially coated with corrosion resistant and non conductive material.

One of the embodiment of the present invention is that cathode is partially coated with corrosion resistant and non conductive material.

One of the embodiments of the present invention is that anode is partially coated with corrosion resistant and non conductive material.

One of the embodiments of the present invention is that cathode is partially coated with non conductive material and/or cathode can be partially coated with non conductive material at least in one plane.

In this invention, during the operation the electrolyte is passed in a close loop system. With the passage current for particular interval of time, copper get deposited on the cathode surface in the form of powder. Current is stopped for fraction of time and deposited copper is removed by use of mechanical scrubber 19 (FIG. 4). This effect causes the copper to be removed from the cathode surface. After removal of copper powder the current is switched on. The size and morphology of deposited powder depends on the operating conditions. This procedure was followed alternatively.

While the invention has been described in terms of exemplary embodiments, those skilled in the art will recognize that the invention can be practical with modification and in the spirit and scope of applied claims.

EXAMPLES

Example 1

According to the present invention, the experiments of recovery of copper metal by electrolysis of cuprous chloride were carried out in the above mentioned electrochemical cell using cuprous chloride in hydrochloric acid as electrolyte. The electrolyte was pumped through their respective compartments using peristaltic pump.

Figure 5:
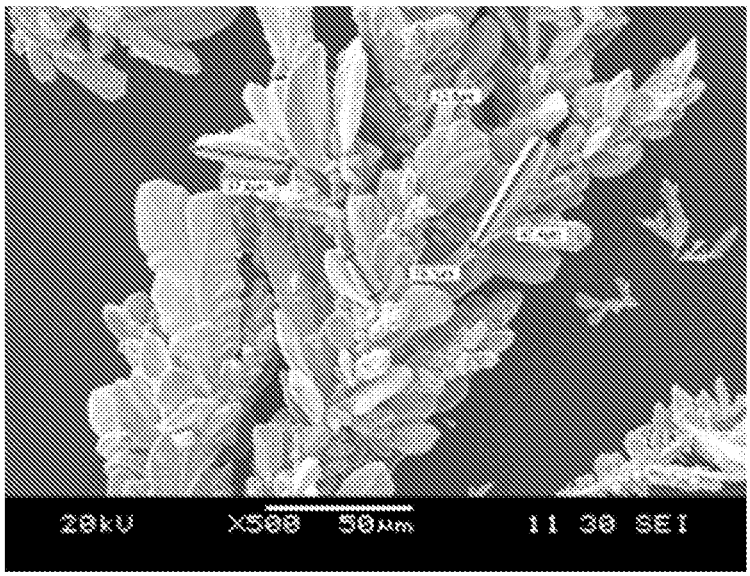
FIG. 5 shows scanning electron microscopy (SEM) images of deposited copper powder.
Figure 6:
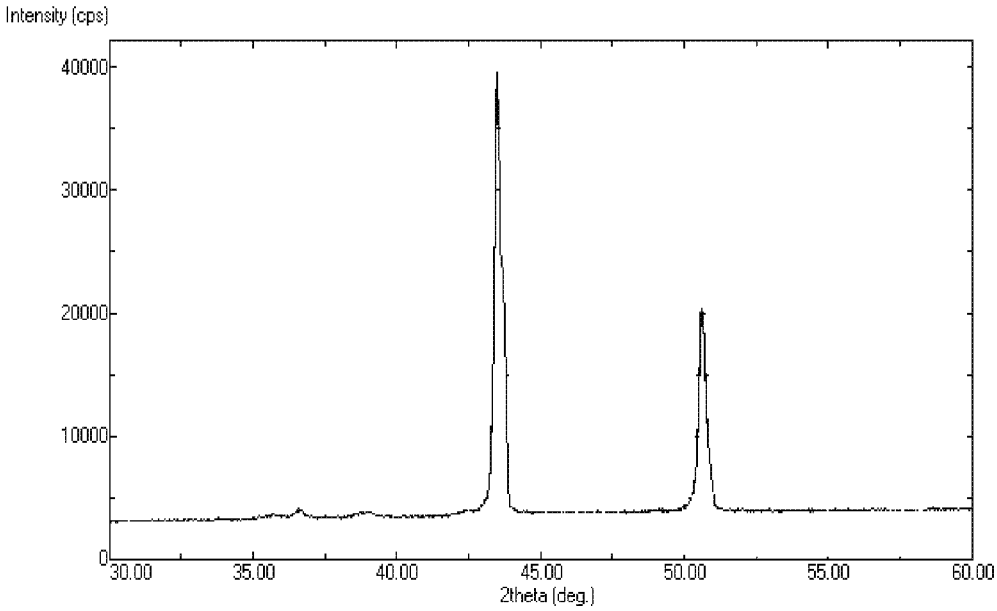
FIG. 6 shows X-ray diffraction (XRD) pattern of deposited copper powder.

Recovery of copper metal from cuprous chloride was carried out at room temperature by applying 100 mA/cm$^2$ cathodic current density. The scaning electron microscopy (SEM) image obtained for copper metal formed during electrolysis is shown in FIG. 5. The X-Ray Diffraction (XRD) pattern of deposited copper is shown in FIG. 6.

Example 2

According to the present invention, the experiments of recovery of silver metal by electrolysis of silver nitrate were carried out in the above mentioned electrochemical cell using silver nitrate in nitric acid as electrolyte. The electrolyte was pumped through their respective compartments using peristaltic pump.

Figure 7:
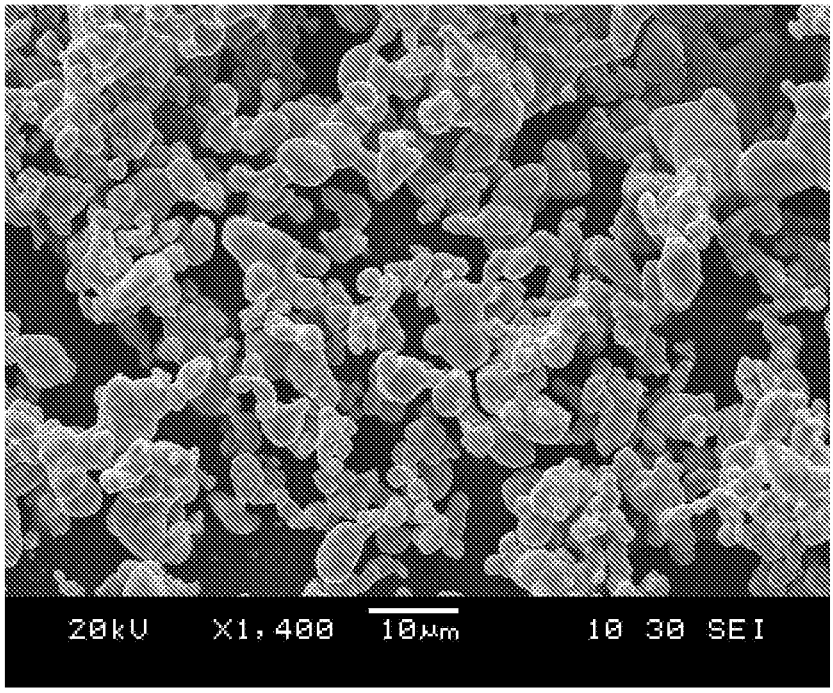
FIG. 7 shows scanning electron microscopy (SEM) image of deposited silver powder.
Figure 8:
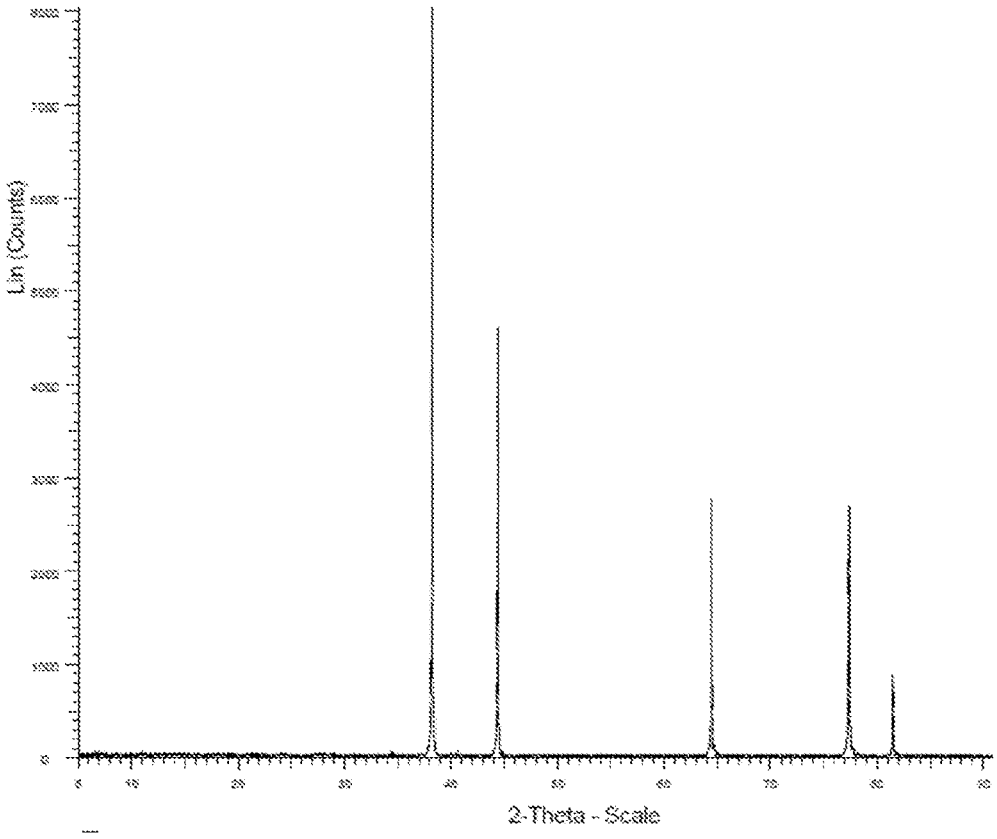
FIG. 8 shows X-ray diffraction (XRD) pattern of deposited silver powder.

Recovery of silver metal from silver nitrate was carried out at room temperature by applying 60 mA/cm$^2$ cathodic current density. The scaning electron microscopy (SEM) image obtained for silver metal formed during electrolysis is shown in FIG. 7. The X-Ray Diffraction (XRD) pattern of deposited silver is shown in FIG. 8.

Example 3

According to the present invention, the experiments of recovery of zinc metal by electrolysis of zinc nitrate were carried out in the above mentioned electrochemical cell using zinc nitrate in nitric acid as electrolyte. The electrolyte was pumped through their respective compartments using peristaltic pump.

Figure 9:
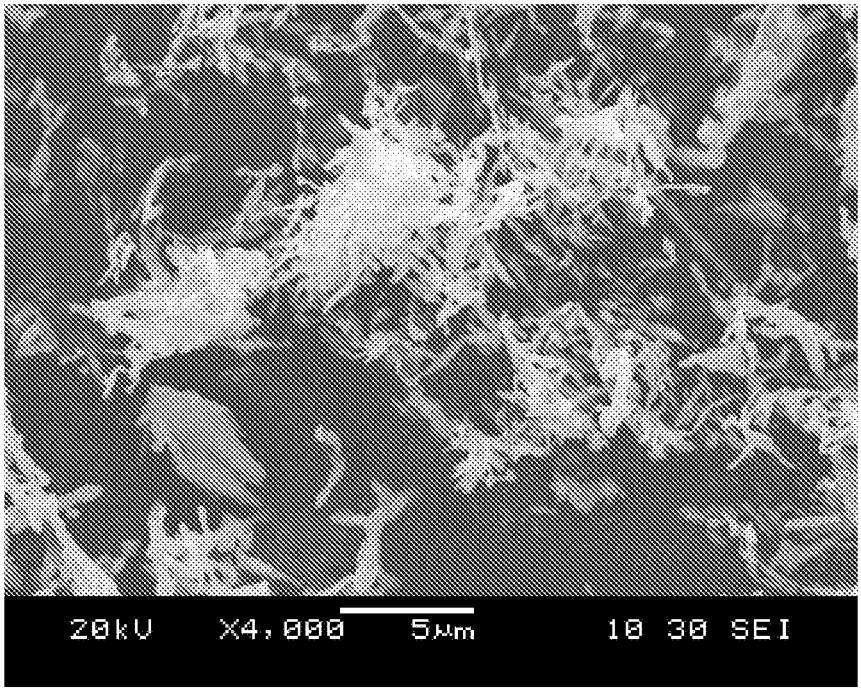
FIG. 9 shows scanning electron microscopy (SEM) image of deposited zinc powder.
Figure 10:
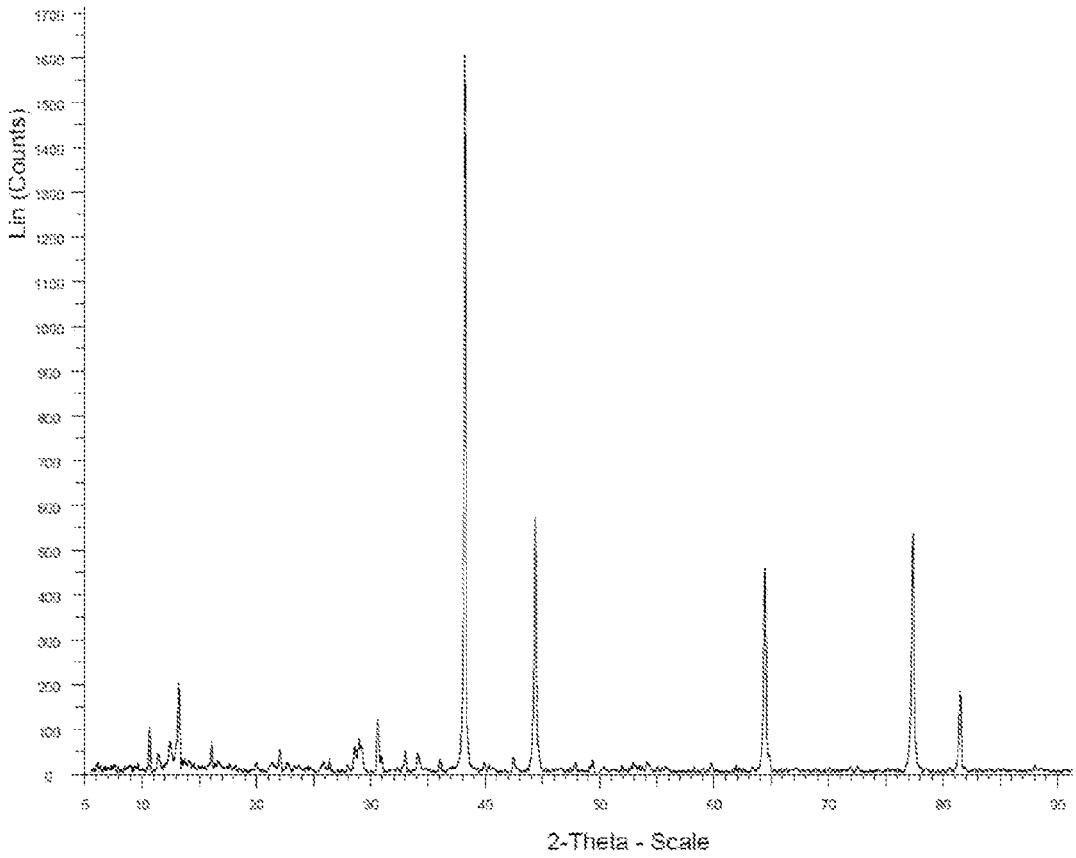
FIG. 10 shows X-ray diffraction (XRD) pattern of deposited zinc powder.

Recovery of zinc metal from zinc nitrate was carried out at room temperature by applying 100 mA/cm$^2$ cathodic current density. The scaning electron microscopy (SEM) image obtained for zinc metal formed during electrolysis is shown in FIG. 9. The X-Ray Diffraction (XRD) pattern of deposited zinc is shown in FIG. 10.

Example 4

According to the present invention, the experiments of recovery of lead metal by electrolysis of lead nitrate were carried out in the above mentioned electrochemical cell using zinc nitrate in nitric acid as electrolyte. The electrolyte was pumped through their respective compartments using peristaltic pump.

Figure 11:
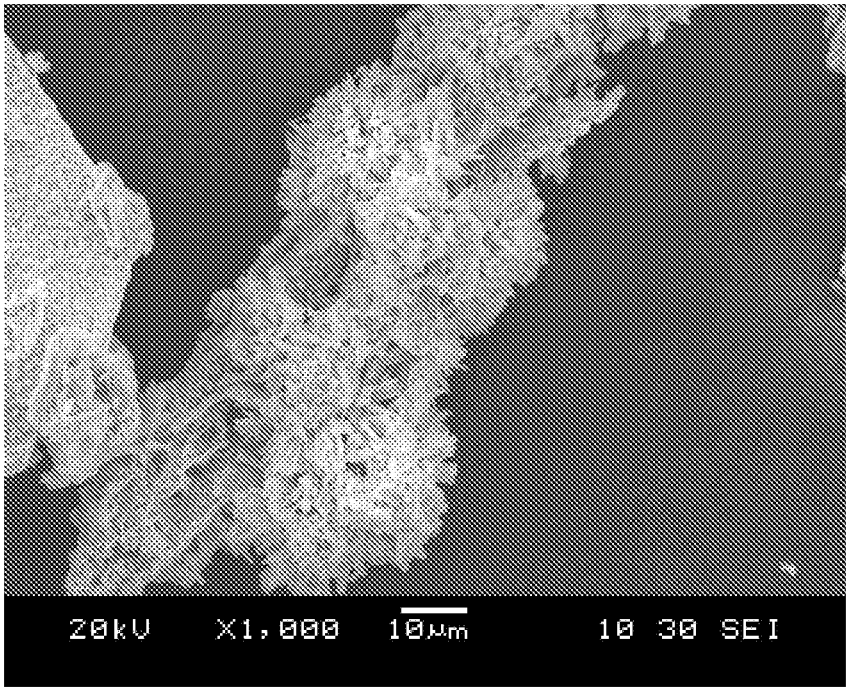
FIG. 11 shows scanning electron microscopy (SEM) image of deposited lead powder.
Figure 12:
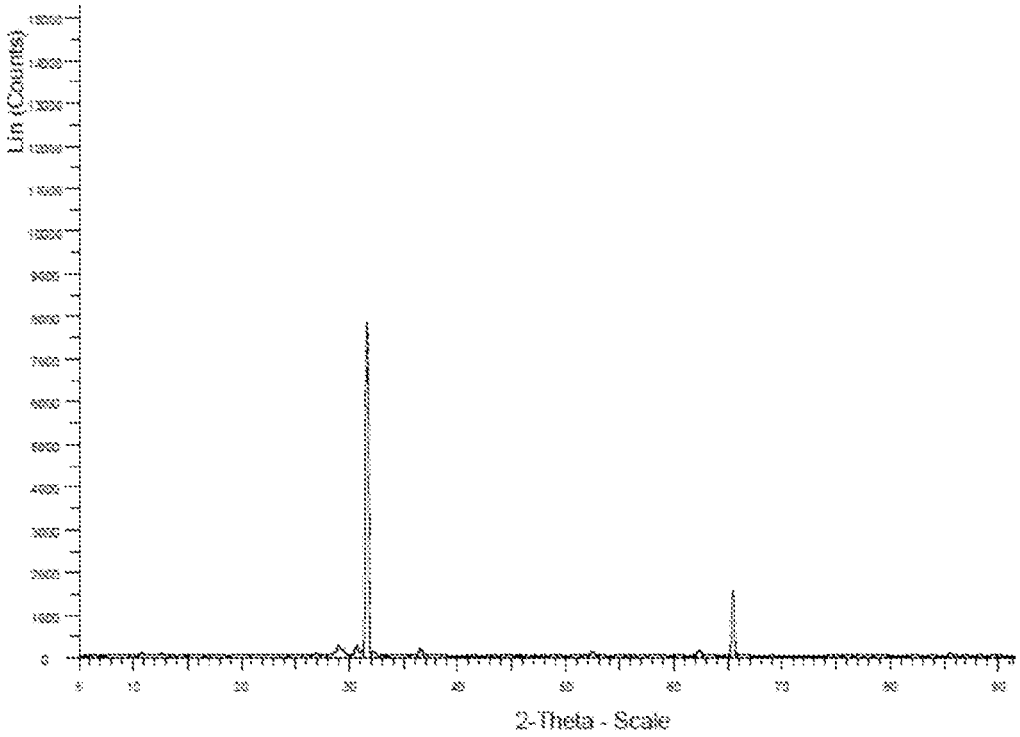
FIG. 12 shows X-ray diffraction (XRD) pattern of deposited lead powder.

Recovery of lead metal from zinc nitrate was carried out at room temperature by applying 100 mA/cm$^2$ cathodic current density. The scaning electron microscopy (SEM) image obtained for lead metal formed during electrolysis is shown in FIG. 11. The X-Ray Diffraction (XRD) pattern of deposited zinc is shown in FIG. 12.

The invention claimed is:

1. An electrochemical cell for recovery of metals comprising of:

a) at least one anode disposed in electrolyte;

b) at least one cathode disposed in electrolyte;

c) at least one ion exchange membrane disposed between anode compartment and cathode compartment;

d) a corrosion resistant material as a support to the ion exchange membrane;

e) at least one scraper to remove deposited metal from the cathode; and f) at least one catholyte trapper to collect scraped metal powder;

wherein the cathode and anode have a surface area ratio in the range of 1:6 to 1:50 and the support has openings of any geometrical shape having a surface area covered in the range of 10% to 95% of total area of the support.

2. The electrochemical cell according to claim 1, wherein the cathode is coaxial and at the center of the anode.

3. The electrochemical cell according to claim 1, wherein the anode is composed of a material selected from corrosion resistant conductive metals, conductive carbon material and any non-conductive material coated by conductive materials.

4. The electrochemical cell according to claim 1, wherein the anode is hollow graphite having any geometry.

5. The electrochemical cell according to claim 1, wherein the cathode is composed of a material selected from corrosion resistant conductive metals, conductive carbon material and any non-conductive material coated by conductive materials.

6. The electrochemical cell according to claim 1, wherein the cathode is copper.

7. The electrochemical cell according to claim 1, wherein both ends of the anode are kept open.

8. The electrochemical cell according to claim 1, wherein the cathode and anode have a surface area ratio in the range of 1:6 to 1:15.

9. The electrochemical cell according to claim 1, wherein the support is made of corrosion resistant and non-conductive material.

10. The electrochemical cell according to claim 1, wherein the support is composed of a ceramic, thermoplastic or thermoset polymeric material.

11. The electrochemical cell according to claim 1, wherein the openings of any size and shape on the support are uniformly distributed.

12. The electrochemical cell according to claim 1, wherein the scraper is composed of corrosion resistant and non-conductive material.

13. The electrochemical cell according to claim 1, wherein the deposited particles of copper powder obtained have a particle size in the range of 0.001-1000 μm.

14. The electrochemical cell according to claim 1, wherein the scraped metal powder is selected from copper, silver, zinc, and lead.

15. The electrochemical cell according to claim 14, wherein the scraped metal powder is copper.

16. The electrochemical cell according to claim 1, wherein the anode and cathode are partially coated with corrosion resistant and non-conductive material.

17. The electrochemical cell according to claim 1, wherein the cathode is partially coated with corrosion resistant and non-conductive material.

18. The electrochemical cell according to claim 1, wherein the anode is partially coated with corrosion resistant and non-conductive material.

19. The electrochemical cell according to claim 1, wherein the cathode is partially coated with non-conductive material.

20. The electrochemical cell according to claim 1, wherein the cathode is partially coated with non-conductive material at least in one plane.

21. The electrochemical cell of claim 1, wherein current density in the cathode is from about 60 $mA/cm^2$ to about 100 $mA/cm^2$.

* * * * *